US005487495A

United States Patent [19]

Derksen

[11] Patent Number: 5,487,495

[45] Date of Patent: Jan. 30, 1996

[54] MANUALLY ACTUATED DROPPER

[75] Inventor: Klaus Derksen, Karlsbad, Germany

[73] Assignee: Pohl GmbH & Co. K.G., Karlsruhe, Germany

[21] Appl. No.: 226,217

[22] Filed: Apr. 8, 1994

[51] Int. Cl.[6] ..... B65D 37/00

[52] U.S. Cl. ..... 222/209; 222/214

[58] Field of Search ..... 222/209, 213, 222/214, 420; 604/214, 216, 217, 298, 207

[56] References Cited

U.S. PATENT DOCUMENTS

| | | | |
|---|---|---|---|
| 2,966,284 | 12/1960 | Lewis | 222/214 |
| 3,224,650 | 12/1965 | Willits, Jr. | 222/214 |
| 5,226,572 | 7/1993 | Gargione | 222/420 |

FOREIGN PATENT DOCUMENTS

| | | | |
|---|---|---|---|
| 255492 | 2/1988 | European Pat. Off. | 222/420 |

*Primary Examiner*—Andres Kashnikow
*Assistant Examiner*—Philippe Derakshani
*Attorney, Agent, or Firm*—Kenyon & Kenyon

[57] ABSTRACT

A manually actuated dropper device for the mouth of a liquid container that delivers finely metered dosages of liquid is disclosed. The dropper comprises an elastically deformable bellows which can sealingly be fastened onto the mouth of a container along with a threaded cap. The bellows are perforated in a protruding region by a hole serving as a dropper opening. Two spring tongues are also attached to the container; these at least partially surround the bellows and extend substantially parallel to the longitudinal direction of the bellows. The protruding ends of the tongues can be elastically displaced towards each other, thereby squeezing the bellows. Stop surfaces on the spring tongues control the degree to which the bellows are squeezed.

10 Claims, 1 Drawing Sheet

MANUALLY ACTUATED DROPPER

BACKGROUND OF THE INVENTION

The present invention relates generally to a manually actuated dropper device, and more particularly, to a dropper device for attachment to the mouth of a container. Dropper devices of this type typically have an elastically deformable bellows and a protruding region terminating in a perforation that serves as a dropper opening.

Such droppers have been used, for instance, for the administration of eye drops, where it is of great importance to be able to administer a single drop of liquid. In known droppers employed for this application, where the delivery of a precisely metered dose is important, it is nevertheless difficult to limit the amount of liquid to be administered in each case to a single drop.

There remains a need for an improved dropper permitting the administration of a single drop of liquid in a problem free manner even where the dosage process as such cannot be observed visually.

SUMMARY OF THE INVENTION

The present invention meets this need by providing a manually actuated dropper device for the mouth of a liquid container that precisely and accurately meters drops of liquid from a bottle. The dropper has an elastically deformable bellows that extends upwardly to a protruding region that terminates in a perforation that serves as a dropper opening. The bellows are sealingly connected to the mouth of the bottle.

The bellows are at least partially surrounded by two spring tongues that extend substantially parallel to one another in the longitudinal direction of the bellows. The spring tongues terminate in a pair of protruding ends, which can be manually squeezed towards each other, thereby pressing the interiorly situated bellows. The spring tongues have stop surfaces on their upper edges which can be brought into engagement with each other. The degree to which the stop surfaces and the underlying bellows can be brought together is held to a fixed value by the abutment of the stop surfaces. In order to remove a drop of liquid, the dropper container is turned upside down, with the result that the deformable bellows and the dropper opening are filled with a portion of the liquid. The air entrained within the bottle is located above the level of the liquid, forming an air cushion between the surface of the liquid and the wall of the liquid container.

If the protruding ends of the spring tongues are then moved towards each other, they deform the bellows, which has the effect of reducing the volume of the liquid container. Consequently, liquid is pressed by the air cushion through the dropper opening. The process continues until the stop surfaces arranged on the facing ends of the spring tongues come into engagement with each other and a single drop has detached itself from the drop opening. Any further movement of the spring tongues towards each other as well as any further deformation of the bellows is prevented, and inadvertent discharges of liquid from the dropper are reliably avoided. When additional drops are required, the dropper spring tongues and bellows are squeezed again. The spring tongues and the bellows are elastically deformable, so that they always return to their original shape after each use and can thus be used to squeeze additional drops from the container.

The deformation path available for providing a single drop of liquid is determined predominantly by the surface tension of the liquid to be administered. This can be readily determined in each individual case on the basis of empirical tests.

Particularly dependable operation of the dropper device of the invention can be obtained if the ends of the spring tongues surround the bellows in the manner of half shells. The half shells are substantially stable in shape, viewed in the transverse direction. Undesired deformation of the bellows by direct contact with the hand is thereby prevented.

The ends of the spring tongues can be provided with radially outwardly extending grip tabs which lying opposite each other so as to prevent the user's hand from inadvertently sliding along the spring tongues during actuation of the dropper. This is of great advantage in particular where treating portions of human or animal subjects that are sensitive to pain and the rapid, precise administration of medicine is of utmost importance.

The dropper device of the invention can be produced particularly easily and at low cost. It permits an easy dosing of liquids, and, in particular, permits one to administer a single drop of liquid without direct visual control over the procedure. The clinician need only squeeze the device to be assured of obtaining an accurate single-drop dose. He need not be able to see the dropper as it is squeezed.

BRIEF DESCRIPTION OF THE DRAWINGS

The invention will be explained in further detail below with reference to the drawings, in which.

DETAILED DESCRIPTION

Figure 1:
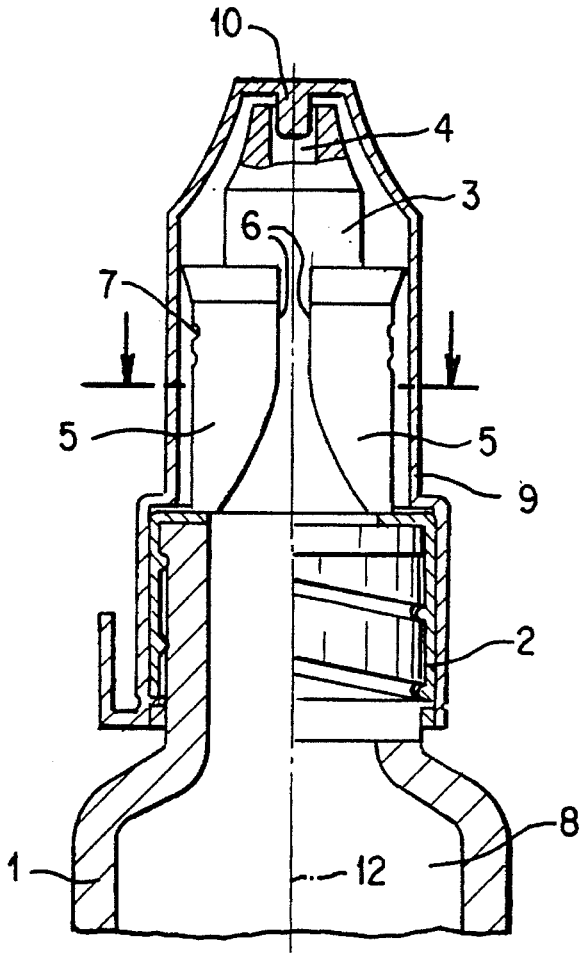
FIG. 1 shows an embodiment of a dropper device constructed in accordance with the principles of the invention, seen in a partial longitudinal section.
Figure 2:
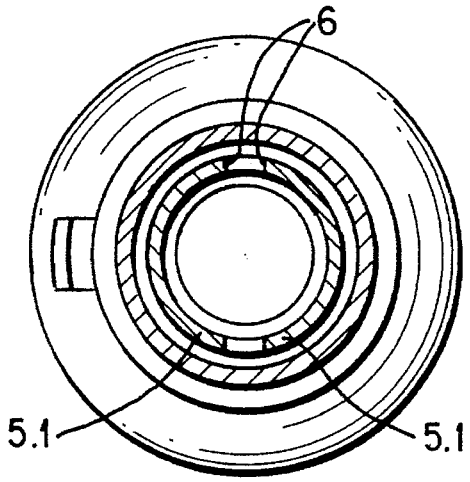
FIG. 2 shows the dropper device of FIG. 1 in a partial transverse section along the line A—A.

The dropper device shown in FIGS. 1 and 2 is intended for the manual administration of eye drops. It comprises an elastically deformable bellows 3 which is perforated by a drop opening 4 in an upwardly protruding end of the bellows. The bellows is sealingly fastened to the mouth of a liquid container 1 of (typically) glass by an attachment means 2 that include a screw cap. The liquid container 1 is partially filled with the liquid 8 to be administered. Over the outside of the attachment means 2, which is developed as a screw cap, a protective cap is placed in a self-locking manner. The protective cap 9 has a bell shape which in its upwardly projecting end is provided with an inwardly extending pin 10 which can be selectively introduced into the drop opening 4 so as to seal it in a liquid-tight manner when the dropper is not in use. The attachment means 2 and the protective cap 9 are made of plastic; the bellows 3 is constructed of rubber.

On the attachment means 2 are provided two spring tongues 5 which partially surround the bellows and extend substantially parallel to the longitudinal axis 12 of the bellows 3. The ends of the spring tongue have grip tabs 7 to prevent any inadvertent slippage of the user's hand along the tongues 5. The protruding ends of the springs are adapted to be brought towards each other and thereby elastically deform the bellows which they surround. Two stop surfaces 6 are provided on the ends of the bellows. In limiting the degree to which the spring tongues can be displaced towards one another, the stop surface concomitantly limit the amount of elastic defamation which the bellows experience to a fixed, predetermined value suitable for dispensing a single drop of liquid. (Of course, where it is desired to dispense a greater quantity of liquid, the maximum displacement of the spring tongues is configured accordingly.)

The ends of the spring tongues surround the bellows in the manner of half shells. Such half-shell structure (5.1 in FIG. 2) shields the bellows against any unintentional elastic deformation due to any means other than the ends of the spring tongues. Furthermore, this structure helps assure that the intended dosage can be dependably maintained even under unfavorable conditions of application which are difficult to verify.

The operation of the dropper shall now be set forth. In order to administer a drop, the protective cap is first removed and the dropper device, including the corresponding liquid container 1, is turned upside down. At least a portion of the volume of liquid 8 contained in the liquid container 1 thereby passes into the inside of the bellows 3 and to the drop opening 4, while the volume of air present (the bottle will typically have a pocket of air) is shifted into the region between the surface of the liquid and the bottom of the liquid container 1. If the ends of the spring tongues 5 are then brought together until the stop surfaces 6 contact each other, the bellows 3 will be simultaneously elastically deformed towards one another, with the result that the air pocket forms a cushion that presses a drop of the volume of liquid out of the drop opening 4 and expels it from the mouth of the drop opening 4. Once the drop is squeezed out, the level of pressure within the bottle is no longer sufficient to squeeze out any additional liquid at this time. The administering of another drop requires that the spring tongues 5 and the bellows be mechanically released until they have again assumed their original shape, permitting additional air to enter the bottle. If the stop surfaces are again displaced towards each other in the manner described above, one again obtains the detachment of a single additional drop of liquid from the drop opening 4.

For this reason, the administering of a single drop does not require any observation or verification. The geometry of the dispensing apparatus provides for a predetermined dose to be delivered with each squeeze of the half shells to the point of their mutual contact. Any unintended leakage of drops, which could foul the surroundings of the place where the drop is to be applied, is reliably prevented.

What is claimed is:

1. A manually actuated dropper device for the mouth of a liquid container, comprising:

an elastically deformable bellows having longitudinal axis and a protruding region, said protruding region of said bellows having a perforation for serving as a dropper opening;

attachment means for sealingly connecting the bellows to the mouth of a container; and two spring tongues connected to said attachment means, said spring tongues being configured to extend at least partially around the bellows and extending substantially parallel to the longitudinal axis of the bellows; said spring tongues having protruding end portions that can be displaced towards each other, thereby deforming the bellows located there between; and stop surfaces on the ends of the spring tongues, wherein the degree to which the spring tongues can be displaced towards each other is limited to a fixed value by the mutual contact of said stop surfaces;

wherein the spring tongues and the protruding region of the bellows having the perforation project upwordly away from the attachment means.

2. A dropper device according to claim 1, wherein the ends of the spring tongues surround the bellows in the manner of half shells.

3. A dropper device according to claim 1, wherein the ends of the spring tongues are provided with radially outward directed grip tabs located opposite each other.

4. A dropper device according to claim 2, wherein the ends of the spring tongues are provided with radially outward directed grip tabs located opposite each other.

5. A dropper device according to claim 1, wherein displacement of the spring tongues towards one another squeezes the bellows located therebetween, so that when the dropper is not pointed vertically upwards, a predetermined quantity of liquid is forced through the dropper opening.

6. A device for administering controlled doses of liquid, comprising:

I) a container having a mouth; and

II) a dispenser fitted to the mouth of the container, said dispenser comprising:

an elastically deformable bellows having longitudinal axis and a protruding region, said protruding region of said bellows having a perforation for serving as a dropper opening, the protruding region of said bellows projecting upwardly away from the container so that the perforation is axially displaced away from the container;

attachment means for sealingly connecting the bellows to the mouth of a container; and two spring tongues connected to said attachment means and protruding upwardly away from the container, said spring tongues i) being configured to extend at least partially around the bellows and extending substantially parallel to the longitudinal axis of the bellows;

ii) said spring tongues having protruding end portions that can be displaced towards each other, thereby deforming the bellows located there between; and iii) stop surfaces on the ends of the spring tongues, wherein the degree to which the spring tongues can be displaced towards each other is limited to a fixed value by the mutual contact of said stop surfaces.

7. A device as set forth in claim 6, wherein the ends of the spring tongues surround the bellows in the manner of half shells.

8. A device as set forth in claim 6, wherein the ends of the spring tongues are provided with radially outward directed grip tabs located opposite each other.

9. A device as set forth in claim 7, wherein the ends of the spring tongues are provided with radially outward directed grip tabs located opposite each other.

10. A device as set forth in claim 8, wherein displacement of the spring tongues towards one another squeezes the bellows located therebetween, so that when the dropper is not pointed vertically upwards, a predetermined quantity of liquid is forced through the dropper opening.

* * * * *